US005202733A

United States Patent [19]

Hediger et al.

[11] Patent Number: 5,202,733

[45] Date of Patent: Apr. 13, 1993

[54] IMAGE FORMING APPARATUS HAVING A TRANSFER MEMBER

[75] Inventors: Edwin A. Hediger, Fairport; John R. Thompson, Webster, both of N.Y.

[73] Assignee: Eastman Kodak Company, Rochester, N.Y.

[21] Appl. No.: 896,849

[22] Filed: Jun. 12, 1992

[51] Int. Cl.[5] ..... G03G 15/14; G03G 21/00

[52] U.S. Cl. ..... 355/271; 355/274; 355/277

[58] Field of Search ..... 355/271, 272, 273, 274, 355/276, 277

[56] References Cited

U.S. PATENT DOCUMENTS

| | | | |
|---|---|---|---|
| 3,893,761 | 7/1975 | Buchan et al. | 355/272 |
| 3,920,325 | 11/1975 | Swift | 355/271 |
| 4,821,066 | 4/1989 | Foote, Jr. et al. | 355/212 X |
| 4,884,105 | 11/1989 | Joseph et al. | 355/212 |
| 4,933,727 | 6/1990 | Mizuma et al. | 355/272 X |

*Primary Examiner*—Fred L. Braun
*Attorney, Agent, or Firm*—Leonard W. Treash

[57] ABSTRACT

An image forming apparatus includes an image member, for example, an endless web photoconductor, and a transfer member, for example, a transfer drum. The endless web is driven by a frictional engagement with a drive roller. A web drive output roller fixed to and rotatable with the drive roller in turn drives an idler roller which drives a drive belt positioned around the idler roller and a transfer drive member. The transfer drive member is fixed with respect to the transfer drum and rotates the transfer drum. The outside diameter of the transfer drive member is maintained equal to that of the transfer drum despite varying ambient conditions, by employing similar materials, for example, employing a similar thickness of polyurethane as the outside layer of the transfer drive member. Thus, the peripheral speed of the transfer drum stays the same as the image member despite a varying outside diameter of the transfer drum as ambient conditions vary.

15 Claims, 2 Drawing Sheets

IMAGE FORMING APPARATUS HAVING A TRANSFER MEMBER

This invention relates to image forming apparatus having a transfer member, and more particularly, to a drive for such an apparatus. Although not limited thereto, it is particularly usable in superimposing different color toner images on an intermediate transfer member to form a multicolor image.

U.S. Pat. No. 4,821,066 to Foote et al, issued Apr. 11, 1989, shows a multicolor image forming apparatus in which a photoconductive belt is driven by a sprocket having teeth fitting into perforations in the belt. The sprocket is fixed to a transfer roller. A second sprocket is fixed to a printhead roller and is monitored by an encoder which controls formation of images on the belt. The sprocket holes are used to continually provide registration of the images as they are transferred either to a receiving sheet carried by the transfer drum or to the transfer drum itself. This system has many advantages including a continual adjustment for any changes in speed of the belt. Since the system relies on sprocket drive, it requires a strong web and the expense of two sprockets.

U.S. Pat. No. 4,884,105 granted to Joseph et al on Nov. 28, 1989 shows a color system in which the web is frictionally driven but contains perforations. A single frame perforation is sensed to control image creation by flash exposure. A set of closely spaced perforations drives a sprocket in the vicinity of a transfer drum which is used to control the position of the transfer drum, for example, by directly driving the drum. This system is also quite accurate, providing the relationship of the sprocket to the transfer drum does not change. If the transfer drum has a polyurethane or similar exterior layer, the outside diameter of the drum will vary, and the speed of the transfer drum can vary slightly from the speed of the web, reducing the registration of the system.

Other systems are known in which a transfer drum and a photoconductive drum are controlled by their own stepping motors and are continuously monitored with encoders to control registration. In addition to being a relatively complex system, this approach may still not take into consideration a change in diameter of the transfer drum.

SUMMARY OF THE INVENTION

It is an object of the invention to control the rotation of a transfer member with respect to an image member despite a variation in ambient conditions that affects the outside diameter of the transfer member.

These and other objects are accomplished by an image forming apparatus which includes an endless image member movable through an endless path, means for forming a toner image on the image member, a transfer member having an outer surface in transfer relation with the image member and at least one layer of material which causes the outside diameter of the outer surface to vary in response to varying ambient conditions. A rotatable transfer drive member, fixed to or integral with the transfer member, has a drive surface of the same outside diameter as the outer surface of the transfer member. It also contains a layer of material having a comparable response to ambient conditions as that of the outside layer of the transfer member. The transfer member is driven utilizing the transfer drive member which, because it varies in outside diameter with the receiving surface, automatically compensates for changing ambient conditions and provides consistent drive of the transfer member.

According to a preferred embodiment, the image member is an endless web trained about a series of rollers, including a web drive roller. The web drive roller includes a shaft upon which is fixed an image member drive output roller (sometimes called a "web drive output roller") having the same outside diameter as the web drive roller. An idler roller frictionally engages and is driven by the web drive output roller and supports a drive belt, which is preferably metal, for example, stainless steel, and which is trained about the idler roller and the transfer drive member.

Because the web drive output roller has the same outside diameter as the web drive roller, the drive belt is driven at the same speed as the image member. Because the transfer drive member has the same outside diameter under all ambient conditions as the transfer member, the transfer member is driven by the drive belt to have the same surface speed as the image member. This apparatus, thus closely controls the speed of the transfer member with respect to the speed of the image member. It does it without the use of sprockets or complicated electronic mechanism.

If the speed of the image member can be held reasonably constant back between image formation and image transfer, a minimum of other control devices are necessary. If the web includes a seam, it may be desirable to sense the seam to assure that it does not appear in an image.

DESCRIPTION OF THE PREFERRED EMBODIMENT

Figure 1:
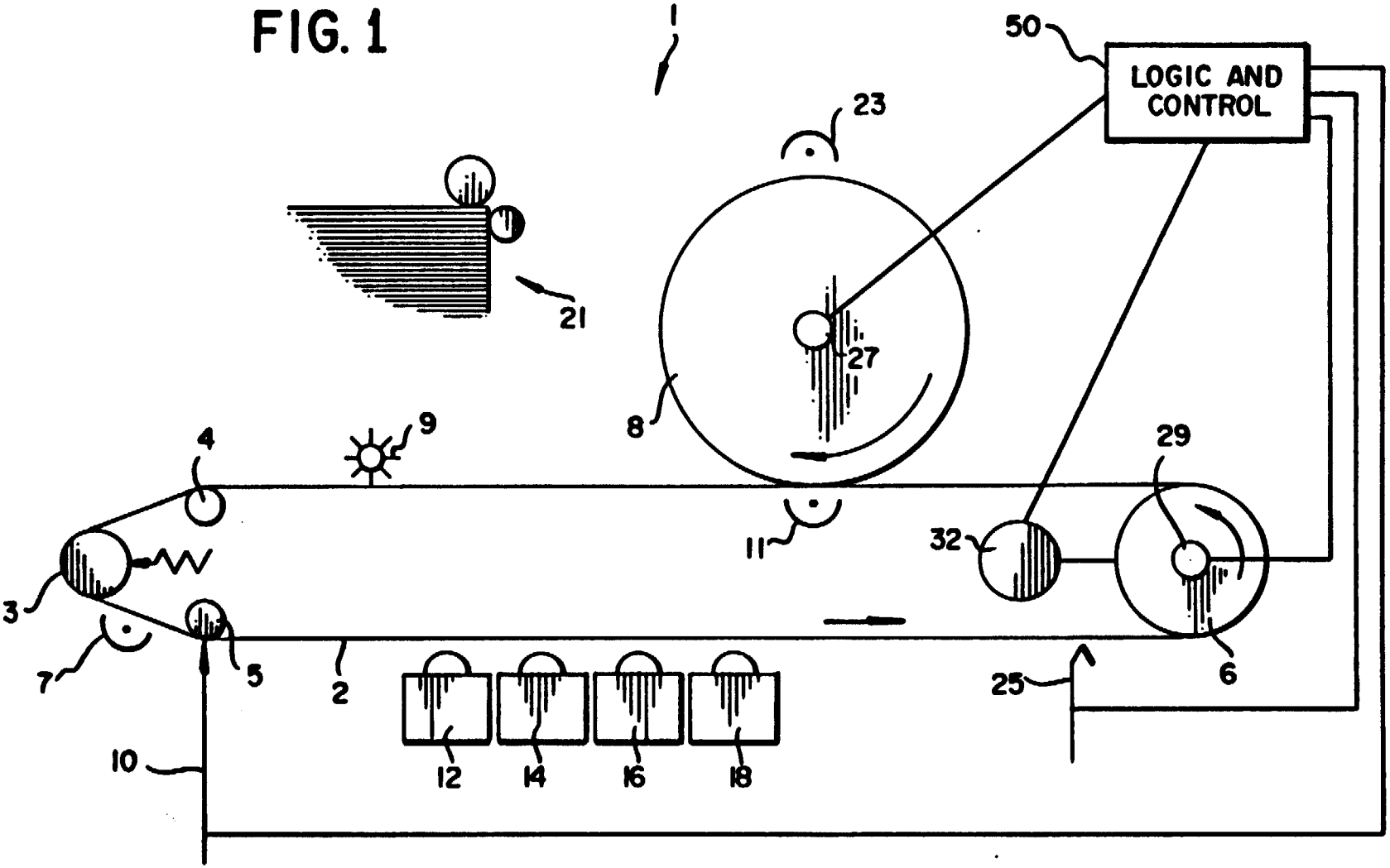
FIG. 1 is a side schematic of an image forming apparatus.

According to FIG. 1, an image forming apparatus 1 provides multicolor toner images on a receiving sheet. An image member, for example, an endless web photoconductor 2 is trained about a series of rollers, 3, 4, 5 and 6. Rollers 4, 5 and 6 have fixed axes, while roller 3 has a movable axis which is spring urged to the left (as shown in FIG. 1) to properly tension image member 2. Roller 6 is an image member drive roller (sometimes called a "web drive roller") which is driven by a suitable drive means, for example, a motor 32, to frictionally move image member 2 past a series of electrophotographic stations.

As in conventional color electrophotography, the image member 2 is uniformly charged at a charging station 7, imagewise exposed at an exposure station, for example, a laser 10, to create a series of electrostatic images. Each of the images is toned by a different one of toning stations 12, 14, 16 and 18, which toning stations apply different colors toners to the different images to create a series of different color toner images.

The different color toner images are transferred in registration to an outside transfer surface of a transfer member, for example, a transfer drum 8, to form a multicolor toner image on the outside transfer surface. After the multicolor image has been formed on the transfer drum 8, a receiving sheet is fed from a receiving sheet supply 21 into transfer relation with the multicolor image at a transfer station 23 where the multicolor image is transferred to the receiving sheet. The receiving sheet is separated from the transfer member 8 by means not shown and fed to a fuser or other suitable fixing device and ultimately to an output hopper, also not shown. The image member 2 is cleaned at a cleaning station 9 before it continues back through the image forming stations. It is also conventional to clean the transfer drum by an articulating transfer drum cleaner, not shown. Each of the individual toner images is transferred to the outside transfer surface of transfer member 8 by a suitable transfer device such as corona charging transfer device 11.

Systems such as those shown in FIG. 1 using an intermediate drum or web to accumulate color images forming a multicolor image have been suggested in the literature for many years. However, they present serious timing and registration problems in actual practice. Registration is provided in the apparatus according to FIG. 1, generally by properly positioning the images at the exposure station 10 and by assuring that the outside transfer surface of transfer member 8 is moving at the same speed as image member 2. An encoder 27 is positioned on the shaft of transfer drum 8 and signals the exact angular position of transfer drum 8 to a logic and control 50. In response to that signal, logic and control 50 controls laser 10 to begin the scanning of each image at an appropriate time to superimpose the images on the outside surface of transfer drum 8. This system will provide excellent registration providing the relative movement of image member 2 and transfer drum 8 is carefully controlled.

Figure 3:
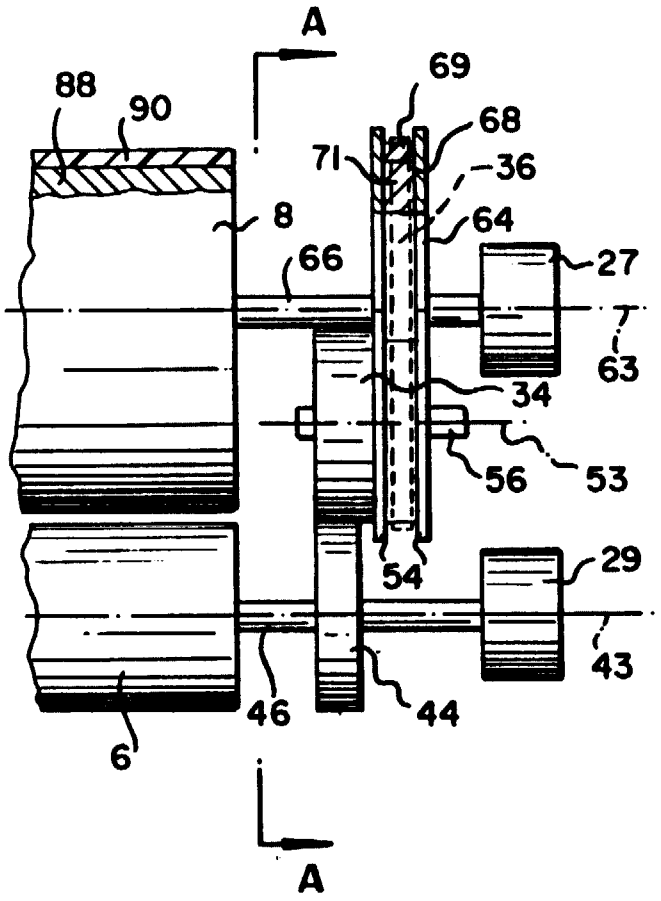
FIG. 3 is a top view with portions eliminated and portions in section of a portion of the image forming apparatus shown in FIG. 1.

Referring to FIG. 3, transfer drum 8 is constructed of a metal core 88 and an elastomeric outer layer 90 generally of a relatively hard polyurethane. Materials such as polyurethane used for outer layer 90 vary somewhat in ambient conditions. For example, they have a tendency to absorb moisture and, therefore, contract somewhat in dry conditions. Even if image member 2 and transfer drum 8 are driven by closely synchronized stepper motors, this change in outside diameter of transfer drum 8 can cause misregistration that is unacceptable for highest quality work. The same is the case when the drive for the transfer drum 8 is controlled by a sprocket or other structure sensing the movement of image member 2. An inconvenient solution sometimes used is to provide a different transfer drum in the winter than is provided in the summer in cold weather climate locations.

Figure 2:
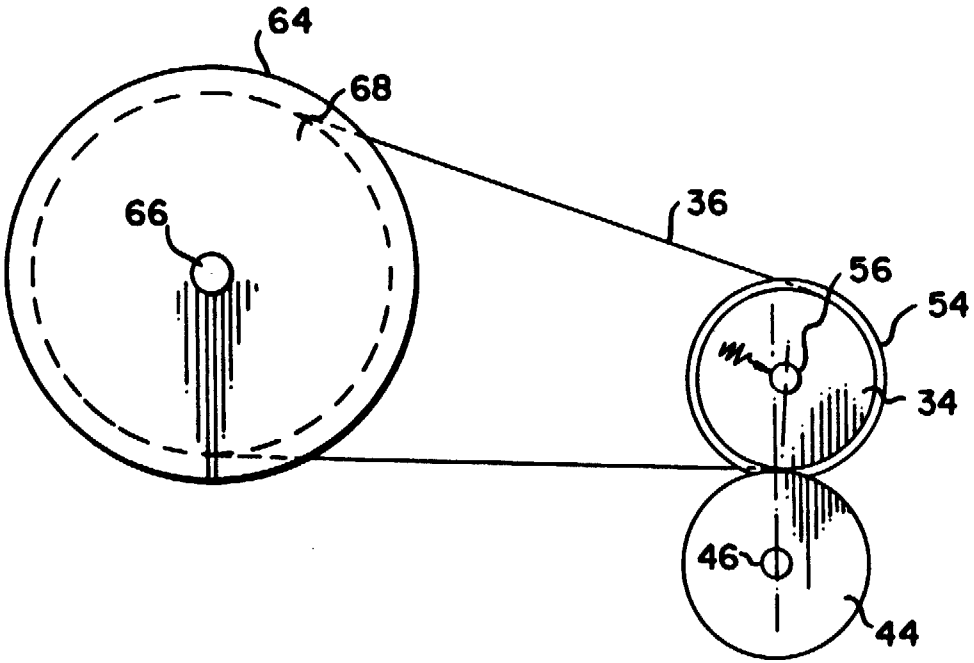
FIG. 2 is a side view taken along the line A—A in FIG. 3.

As seen in FIGS. 2 and 3, transfer drum 8 is driven through a drive transmission including image member drive roller 6. Drive roller 6 is fixed to a shaft 46 to which is also fixed a web drive output roller 44 and an encoder 29, all of which rotate about an axis of rotation 43. As drive roller 6 is rotated by motor 32 (FIG. 1), web drive output roller 44 rotates at the same speed. Web drive output roller 44 has the same outside diameter as drive roller 6 and, thus, the same peripheral speed as well. Web drive output roller 44 frictionally engages an idler roller 34 which is rotatable about an axis 53 by such frictional engagement. Idler roller 34 also includes flanges 54 for holding a stainless steel drive belt 36 (shown in phantom in FIG. 3). Drive belt 36 is moved by idler roller 34 at the same speed that drive roller 6 drives image member 2.

Drive belt 36 is positioned around a transfer drive member 68 which is fixed to a shaft 66 to which transfer drum 8 and encoder 27 are also fixed. Shafts 46 and 66 are fixed so that drive roller 6, web drive output roller 44, transfer drum 8 and transfer drive member 68 all rotate about axes 43 and 63 which are fixed. Shaft 56 is spring urged, as shown in FIG. 2, so that the actual position of axis 53 about which idler 34 rotates is determined by the length of drive belt 36.

Since belt 36 is driven through web drive output roller 44 and idler roller 34 at the same linear speed as image member 2, drive belt 36 will drive transfer drum 8 at a speed in which the outside transfer surface of drum 8 moves at the same speed as image member 2, providing transfer drive member 68 has the same diameter as does transfer member 8. To assure equal diameters, transfer drive member 68 is constructed of a metallic core 71 with a layer 69 of a material that reacts to ambient conditions the same as polyurethane layer 90 on transfer drum 8. Preferably, layer 69 is made of the same polyurethane and is of the same thickness as layer 90 and, thus, expands and contracts with changes in humidity in the same amount. Thus, although changes in humidity may vary the outside diameter of transfer drum 8, the outside transfer surface of drum 8 continues to move at the same speed as image member 2 despite any such changes in its outside diameter.

Although transfer drive member 68 and transfer drum 8 are shown as separate elements, they could be a single integral unit. The same is true of web drive output roller 44 and drive roller 6.

Referring to FIG. 1, a seam sensor 25 senses the passing of any seam necessary in image member 2. The output of sensor 25 is combined by logic and control 50 with the output of encoder 29 to assure no image is written over the seam. For example, a start-of-scan signal can be sent to laser 10 a certain number of clock pulses after sensing of the seam by sensor 25, which number of clock pulses is indicative of the time it takes for the seam to just pass laser 10. From that start-of-scan signal on, scan is controlled by a signal from encoder 27. A start-of-scan signal is sent to laser 10 once for each revolution of transfer drum 8. If two images are formed for each revolution of transfer drum 8, then the start-of-scan signals would be appropriately doubled. As is well known in the art, a variety of algorithms can be used to assure that the seam does not appear in an image. For example, if the belt is three image frames long, the first start-of-scan signal can be slightly more than one frame prior to the seam as clocked by encoder 29. These algorithms are dependent upon the size of the belt and the variety of intrack image dimensions.

Note that this invention can be used in a single-color image forming apparatus in order to assure constant speed relationship between a transfer drum and an image member. The attractiveness for the application to color is that, in color image formation, even minor variations in speed show up as a visible misregistration of color.

Note that the invention could also be used when transfer drum 8 is not an intermediate transfer member but is in fact a transfer drum to which a receiving sheet is affixed. In such a known apparatus, image writing must not only miss the seam in image member 2 but it must also register with vacuum holes or holding fingers on the transfer drum for securing the sheet. This adds more complexity to the timing sequence and, therefore, makes the simplicity of this system not quite as attractive as it is when drum 8 is an intermediate.

Note also that motor 32 can directly drive drive roller 6 or can drive an element on any of the three shafts 46, 56 and 66. Because shaft 56 is not fixed, driving an element on either shaft 46 or 66 is preferred.

The invention also can be used whether the image member is drum-shaped or web-shaped and whether the transfer member is drum-shaped or web-shaped. However, the problem solved is most likely to be most severe with a drum-shaped transfer member having a polyurethane or similar outer layer. Similarly, it is attractive to use with a belt-shaped image member because there are other mechanisms available to synchronize two drums, for example, by direct frictional drive between the outer surfaces of the two drums.

Note also that the metal timing belt 36 could be positioned around a member rotatable with shaft 46 and the belt crossed in order to impart the desired direction of drive to the transfer drum. This would have the advantage of eliminating the idler 34, but introduces a crossed belt configuration which is generally considered not desirable for metal belts, especially in high precision timing applications.

The invention has been described in detail with particular reference to a preferred embodiment thereof, but it will be understood that variations and modifications can be effected within the spirit and scope of the invention as described hereinabove and as defined in the appended claims.

We claim:

1. Image forming apparatus comprising:

an endless web image member movable at a speed through an endless path, a transfer drum having an outside transfer surface rotatable through transfer relationship with said image member and having at least one layer of material which causes the diameter of the transfer surface to vary in response to varying ambient conditions, a rotatable drive member, fixed to or integral with said transfer drum, which drive member has a drive surface of the same diameter as the transfer drum and a layer of material of substantially the same thickness and respense to ambient conditions as said at least one layer of the transfer drum to vary the outside diameter of the drive surface the same as the variance in the outside diameter of the transfer drum in response to varying ambient conditions, first drive means movable through an endless path for engaging and frictionally driving the drive surface of said rotatable drive member, and second drive means for driving said first drive means at the same speed as said image member.

2. Image forming apparatus according to claim 1 wherein said first drive means is a drive belt and said second drive means includes an image member drive roller for frictionally driving said image member, an image member drive output roller fixed with respect to said image member drive roller and rotatable therewith and having an outside diameter equal to that of said image member drive roller, an idler roller about which said drive belt is trained, said image member drive output roller being positioned to engage and frictionally drive said idler roller.

3. Image forming apparatus according to claim 1 further including an encoder positioned to monitor the angular position of said transfer drum and logic and control for controlling image formation on said image member in response to the angular position of said transfer drum.

4. Image forming apparatus according to claim 1, wherein said image member is an endless web including a seam and said image forming apparatus further includes means for sensing the position of said seam and a logic and control responsive to said sensing for controlling the formation of images on said belt without the overlap of an image with said seam.

5. An image forming apparatus comprising:

an image member movable through an endless path, means for forming a toner image on said image member, transfer means movable through an endless path to bring a transfer surface through transfer relation with the image member, said transfer means including a rotatable transfer drum having an outside diameter which controls the speed of the transfer surface relative to the rotational speed of the drum, and at least one layer of material which varies in at least one dimension in response to varying ambient conditions, and which in turn varies the outside diameter of said drum as said material dimension varies, drive means for driving both said image member and said transfer means through their endless paths, said drive means including:

a transfer drive member rotatable with said transfer drum and having an outside diameter equal to the outside diameter of the transfer drum, a drive belt positioned around said transfer drive member, means for driving said drive belt at a speed equal to the speed of said image member, wherein the transfer drive member includes at least one layer of material which varies with ambient conditions sufficiently to maintain the outside diameter of the transfer drive member equal to the outside diameter of the transfer drum as ambient conditions vary.

6. Image forming apparatus according to claim 5 wherein said transfer surface is the outside surface of the transfer drum and is rotatable through transfer relation with the image member to receive a plurality of different color single-color images from said image member in registration to form a multicolor image.

7. Image forming apparatus according to claim 6 wherein said image member is an endless web trained about a plurality of image member rollers, at least one of said image member rollers being an image member drive roller which frictionally drives said image member.

8. Image forming apparatus according to claim 7 wherein said drive means further includes a web drive output roller affixed to said image member drive roller and having an outside diameter equal to that of said image member drive roller and an idler roller frictionally driven by said web drive output roller and wherein said drive belt is trained about said idler roller and said transfer drive member.

9. Image forming apparatus according to claim 6 wherein said layers of material in both said transfer drum and said transfer drive member that vary with ambient conditions are of equal thicknesses of the same material.

10. Image forming apparatus according to claim 5 wherein said image member is an endless belt trained about a plurality of image member rollers, at least one of said image member rollers being an image member drive roller which frictionally drives said image member.

11. Image forming apparatus according to claim 10 wherein said layers of material in both said transfer drum and said transfer drive member that vary with ambient conditions are of equal thicknesses of the same material.

12. Image forming apparatus according to claim 11 wherein said material expands with an increase in relative humidity.

13. Image forming apparatus according to claim 5 further including an encoder positioned to monitor the angular position of said transfer drum and logic and control for controlling image formation on said image member in response to the angular position of said transfer drum.

14. Image forming apparatus comprising:

an endless web image member trained about a plurality of rollers for movement through an endless path, means for forming a series of single-color toner images on said image member, an intermediate transfer drum having an outside transfer surface rotatable through transfer relation with said image member and at least one layer of material which causes the outside diameter of the transfer surface to vary in response to varying ambient conditions, a rotatable transfer drive member, fixed to or integral with said transfer drum, which drive member has a drive surface of the same outside diameter as the transfer surface and a layer of material of substantially the same thickness and response to ambient conditions as said at least one layer of the transfer drum, drive means for driving both the image member and the transfer drum, said drive means including, an image member drive roller for frictionally engaging and driving said image member, a web drive output roller fixed with respect to, rotatable with and having the same outside diameter as said image member drive roller, an idler roller frictionally engaging and drivable by said web drive output roller, a timing belt positioned around said transfer drive member and said idler roller for driving said transfer drive member and said transfer drum in response to rotation of said idler roller by said web drive output roller, and means for rotating said image member drive roller and said web drive output roller to move both said image member and said transfer surface at the same speed.

15. Image forming apparatus according to claim 14 further including means for transferring said toner images in registration to said transfer surface to form a multicolor image and means for transferring said multicolor image to a receiving sheet.

* * * * *